US009039544B2

(12) United States Patent
Wachi

(10) Patent No.: US 9,039,544 B2
(45) Date of Patent: May 26, 2015

(54) GOLF BALL AND GOLF BALL MANUFACTURING METHOD

(75) Inventor: Toshiro Wachi, Gifuken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 328 days.

(21) Appl. No.: 13/614,101

(22) Filed: Sep. 13, 2012

(65) Prior Publication Data

US 2014/0073452 A1 Mar. 13, 2014

(51) Int. Cl.

| | |
|---|---|
| ***A63B 37/00*** | (2006.01) |
| ***A63B 37/04*** | (2006.01) |
| ***A63B 45/00*** | (2006.01) |

(52) U.S. Cl.

CPC ..... *A63B 37/0074* (2013.01); *A63B 45/00* (2013.01); *A63B 37/0075* (2013.01); *A63B 37/0076* (2013.01); *A63B 37/0024* (2013.01)

(58) Field of Classification Search

USPC ..... 473/324–350, 351–378

See application file for complete search history.

(56) References Cited

U.S. PATENT DOCUMENTS

| | | | | |
|---|---|---|---|---|
| 5,542,680 | A * | 8/1996 | Proudfit et al. | 473/378 |
| 5,589,546 | A | 12/1996 | Hiraoka et al. | |
| 6,120,394 | A * | 9/2000 | Kametani | 473/378 |
| 6,561,923 | B1 * | 5/2003 | Ohama et al. | 473/353 |
| 6,949,595 | B2 * | 9/2005 | Morgan et al. | 524/102 |
| 7,026,381 | B2 * | 4/2006 | Fujisawa et al. | 524/120 |
| 7,829,604 | B2 | 11/2010 | Wachi | |
| 2002/0049100 | A1 * | 4/2002 | Winskowicz | 473/378 |
| 2006/0035719 | A1 * | 2/2006 | Wood | 473/280 |
| 2007/0015602 | A1 * | 1/2007 | Watanabe | 473/371 |
| 2008/0015053 | A1 * | 1/2008 | Watanabe | 473/373 |
| 2008/0254913 | A1 * | 10/2008 | Morgan | 473/360 |
| 2012/0129631 | A1 * | 5/2012 | Sullivan et al. | 473/373 |
| 2014/0250609 | A1 * | 9/2014 | Tutmark et al. | 8/495 |
| 2014/0256468 | A1 * | 9/2014 | Tutmark et al. | 473/371 |

FOREIGN PATENT DOCUMENTS

| | | | |
|---|---|---|---|
| JP | 2652502 | B2 | 5/1997 |
| JP | 2002-102388 | A | 4/2002 |
| JP | 2008-253757 | A | 10/2008 |

* cited by examiner

*Primary Examiner* — Alvin Hunter

(74) *Attorney, Agent, or Firm* — Sughrue Mion, PLLC

(57) ABSTRACT

When manufacturing golf balls having a structural component which is a molded and vulcanized material obtained by vulcanizing a rubber composition containing, as the essential ingredients, a base rubber and an unsaturated carboxylic acid or a salt thereof, the distinguishability of structural components such as cores can be enhanced by including also a soluble pigment within, and thereby coloring, the rubber composition. Moreover, vulcanized rubber powder obtained by rendering processing scrap and waste from such cores into powder can be easily decolorized by liquid washing to remove the pigment, thus enabling advantageous use of the vulcanized rubber powder as a compounding ingredient in the manufacture of other golf ball cores without affecting the color tone of the manufactured balls.

8 Claims, No Drawings

GOLF BALL AND GOLF BALL MANUFACTURING METHOD

BACKGROUND OF THE INVENTION

The present invention relates to a solid golf ball, particularly a solid golf ball having a solid core, such as a two-piece golf ball or a multi-piece golf ball of three or more pieces. The invention also relates to a method of manufacturing such a golf ball.

In order to respond to the diverse needs of the market, the production of solid golf balls having a core and a cover at a manufacturing plant has generally entailed fabricating at the same time many types of golf balls of differing performance attributes such as distance and controllability. From a production control standpoint, a preformed body (either a core or a core having an intermediate layer formed thereon) fabricated prior to formation of the cover is often transferred to a temporary storage place following fabrication and stored until such time as the cover is formed. A preformed body that matches a particular cover to be formed is then selected from among a plurality of types of preformed bodies stored at the temporary storage place, and is supplied to the cover-forming step.

In such cases, selection of the preformed body to be supplied to the cover-forming step is facilitated by including a colorant within or coating a colorant on the preformed body so as to impart color to the body, and having the color of the preformed body differ for each type of ball. Even when a core has been colored in this way, by forming an ordinary white cover over the core, the coloration of the core is completely hidden and does not affect the appearance of the golf ball.

Also, when golf ball cores are obtained by molding and vulcanizing a rubber composition containing a base rubber and an unsaturated carboxylic acid, a vulcanized rubber powder is sometimes included in the rubber composition for such purposes as to enhance stability and adjust the rebound and hardness (see Japanese Patent No. 2652502).

Here, in the golf ball manufacturing operation, vulcanized rubber powder that arises during the surface grinding of cores which have been molded and vulcanized is collected and added to the above rubber composition, whereupon the molding and vulcanization of cores is also carried out. The grinding up and use of the cores of discarded golf balls has also been described (JP-A 2002-102388). In addition, the removal of water-soluble unsaturated carboxylic acids such as acrylic acid, methacrylic acid and salts thereof, as well as other water-soluble monomers and polymers, by liquid-washing vulcanized rubber powder obtained from discarded golf balls, and the use of the resulting washed rubber powder, has also been described (see JP-A 2008-253757).

However, in the case of preformed bodies such as the above-described colored cores, the abraded powder or ground powder obtained from such bodies is also colored. When such powder is added as vulcanized rubber powder to a core, the resulting core will of course be colored. As noted above, there is no particular problem in cases where an ordinary white cover is formed over the core. However, when a cover having a yellow color, for example, is formed over the core in order to produce a so-called colored ball, the color tone of the ball may be affected and undesirably altered by the color of the core. In particular, golf balls have been recently described in which a transparent or translucent resin is used to form the cover, or in which pigment is compounded in a transparent or translucent resin to create a ball that exhibits a vibrant color with a sense of transparency. In such golf balls, no coloration whatsoever of the core is allowable.

SUMMARY OF THE INVENTION

Accordingly, the object of the present invention is to provide a golf ball which includes a preformed body such as a core that can be easily identified, and from which can be generated waste and processing scrap such as abraded powder and trimmings that, when rendered into a powder and reused as a compounding ingredient in cores or the like, can be used without undesirably altering the color tone of the golf balls thereby obtained. Another object of the invention is to provide a golf ball manufacturing method for obtaining novel golf balls using vulcanized rubber powder obtained from such processing scrap and waste.

The inventors have conducted extensive investigations in order to achieve the above objects. As a result, they have discovered that, when obtaining a golf ball which includes, as a structural component such as a core, a molded and vulcanized material obtained by vulcanizing a rubber composition in which a base rubber and an unsaturated carboxylic acid or a salt thereof have been compounded as essential ingredients, by additionally including a soluble pigment in the rubber composition and coloring the core or other structural component according to the type of golf ball, the structural component can be easily identified in the manufacturing operations. They have also found that when powder obtained from processing scrap and waste generated from such structural components is reused as vulcanized rubber powder, the soluble pigment can be removed by liquid washing, thus making it possible to effectively reuse such material without affecting the color tone of the resulting golf balls.

Accordingly, the present invention provides the following golf ball and golf ball manufacturing method.

[1] A golf ball comprising, as a structural component therein, a molded and vulcanized material obtained by vulcanizing a rubber composition comprising a base rubber and an unsaturated carboxylic acid or a salt thereof, wherein the rubber composition additionally includes a soluble pigment.

[2] The golf ball of [1], wherein the soluble pigment is a water-soluble pigment.

[3] The golf ball of [2], wherein the water-soluble pigment is of one or more type selected from among naturally occurring pigments.

[4] The golf ball of [1], wherein the molded and vulcanized material obtained by vulcanizing the rubber composition serves as a core of the ball.

[5] A method of manufacturing a golf ball having, as a structural component therein, a molded and vulcanized material obtained by molding and vulcanizing a rubber composition comprising a base rubber and an unsaturated carboxylic acid or a salt thereof and to which a vulcanized rubber powder has been added, the method comprising the steps of: liquid washing a soluble pigment-containing vulcanized rubber powder so as to remove the soluble pigment; and compounding the liquid-washed vulcanized rubber powder in the rubber composition.

[6] The golf ball manufacturing method of [5], wherein the vulcanized rubber powder has a particle size of not more than 1,000 μm.

[7] The golf ball manufacturing method of [5], wherein the vulcanized rubber powder has, at the time of addition to the rubber composition, a moisture content of not more than 600 ppm.

[8] The golf ball manufacturing method of [5], wherein the vulcanized rubber powder is processing scrap or waste from structural components of other golf balls which has been rendered into a powder.

[9] The golf ball manufacturing method of [8], wherein the vulcanized rubber powder is a powder formed by surface grinding golf ball cores obtained by molding and vulcanizing a rubber composition containing a base rubber, an unsaturated carboxylic acid or a salt thereof, and a soluble pigment.

[10] The golf ball manufacturing method of [5], wherein the soluble pigment is a water-soluble pigment and the vulcanized rubber powder containing the water-soluble pigment is liquid-washed using water.

[11] The golf ball manufacturing method of [10], wherein the soluble pigment is one or more water-soluble pigment selected from among naturally occurring pigments.

[12] The golf ball manufacturing method of [5] which produces a golf ball wherein the molded and vulcanized material obtained by molding and vulcanizing the rubber composition serves as a core.

DETAILED DESCRIPTION OF THE INVENTION

The invention is described in detail below.

The present invention, as noted above, provides a golf ball in which has been formed at least one structural component such as a core obtained by molding and vulcanizing a rubber composition compounded from a base rubber, an unsaturated carboxylic acid or a salt thereof and a soluble pigment. The invention also provides a method of manufacturing a golf ball using a vulcanized rubber powder obtained from processing scrap and waste originating from such ball components. In the description of the invention that follows below, the golf ball invention is also referred to as the "first aspect of the invention," and the manufacturing method invention is also referred as the "second aspect of the invention."

The base rubber is not subject to any particular limitation, although use may be made of a rubber material customarily used in golf balls. Illustrative examples include one type of rubber, or a mixture of two or more types of rubbers, selected from the group consisting of butadiene rubbers, natural rubbers, synthetic isoprene rubbers, styrene-butadiene rubbers, ethylene-α-olefin copolymeric rubbers, ethylene-α-olefin-diene copolymeric rubbers, acrylonitrile-butadiene copolymeric rubbers, chloroprene rubbers and halogenated butyl rubbers. The use of cis-1,4-polybutadiene is especially preferred.

Next, illustrative examples of the unsaturated carboxylic acid include acrylic acid, methacrylic acid, maleic acid and fumaric acid. Acrylic acid and methacrylic acid are especially preferred. Metal salts of unsaturated carboxylic acids include zinc salts and magnesium salts. Of these, preferred use may be made of zinc acrylate.

These unsaturated carboxylic acid and salts thereof are included in an amount which, although not subject to any particular limitation, is preferably from 10 to 60 parts by weight, and especially from 20 to 40 parts by weight, per 100 parts by weight of the base rubber.

In the present invention, a soluble pigment is included in the rubber composition containing the above base rubber and an unsaturated carboxylic acid or a salt thereof so as to impart a desired color to molded and vulcanized materials such as cores obtained from the rubber composition. In this way, after temporarily storing preformed bodies such as cores composed of this molded and vulcanized material, identification of the preformed bodies when they are to be furnished for subsequent operations such as cover molding can be easily carried out.

The soluble pigment should be one that can be removed by liquid washing with a solvent, and may be suitably selected from among known soluble pigments. However, preferred use may be made of a water-soluble pigment because water can be used as the washing liquid and such pigments have a very low toxicity. The water-soluble pigment may be a naturally occurring pigment or a synthetic pigment, although the use of a naturally occurring pigment such as red cabbage pigment, gardenia blue, red radish color, paprika color, cacao pigment, caramel color, chlorophyll, gardenia yellow or safflower yellow is preferred.

Such soluble pigments are included in an amount which may be suitably set according to the type of pigment and the intended degree of coloration (color density), and is not subject to any particular limitation. The lower limit per 100 parts by weight of the base rubber is preferably 0.01 part by weight, and especially 0.05 part by weight, and the upper limit is preferably 2 parts by weight, more preferably 0.5 part by weight, and even more preferably 0.1 part by weight. Here, at an amount below 0.01 part by weight, coloration to a degree that enables a good distinguishability to be obtained may be difficult. On the other hand, at an amount in excess of 2 parts by weight, removing the soluble pigment by liquid washing may be difficult or liquid washing may require a great deal of labor.

In addition, additives and compounding ingredients customarily used in rubber compositions for golf balls may be suitably included in this rubber composition. For example, inorganic fillers such as zinc oxide, calcium carbonate and barium sulfate, organic peroxides such as dicumyl peroxide, 1,1-bis(t-butylperoxy)-3,5,5-trimethylcyclohexane and α,α'-bis(t-butylperoxy)diisopropylbenzene, sulfur (elemental), organosulfur compounds such as pentachlorothiophenol and/or metal salts thereof, and antioxidants may be suitably included.

The amounts of these additives and ingredients included are not subject to any particular limitations, although the amount of such inorganic fillers included per 100 parts by weight of the base rubber is preferably set to from 10 to 60 parts by weight, and especially from 20 to 40 parts by weight, and the amount of organic peroxide included per 100 parts by weight of the base rubber is preferably set to from 0.1 to 1.0 part by weight, and especially from 0.4 to 0.6 part by weight.

In the golf ball of the invention, a molded and vulcanized material obtained by molding and vulcanizing the above rubber composition serves as a structural component such as a solid core. Such molding and vulcanization may be carried out in accordance with conventional practice. A method that involves vulcanization under heating at 150 to 170° C. for a period of from 10 to 20 minutes may be generally employed.

The golf ball of the invention includes the foregoing molded and vulcanized material as one of the structural components. Generally, by using the molded and vulcanized material as the core and forming a cover that directly encases the core or encases the core over an intervening intermediate layer, the inventive golf ball can be obtained as a two-piece solid golf ball or a multi-piece solid golf ball having three or more layers.

The cover may be formed using a material known to be used in golf ball covers. For example, the cover may be formed using an ionomer resin, a polyester-type elastomer, a polyamide-type elastomer, a styrene-type elastomer, a polyurethane-type elastomer, an olefin-type elastomer, or mixtures thereof. Also, the material used to form the intermediate layer may be either a resin material or a rubber-based material. Here, the resin material is exemplified by the same types of resin materials as the cover-forming materials mentioned above.

Dimples on the golf ball are formed in accordance with conventional practice. The shape, types, arrangement and combination of such dimples may be suitably designed in accordance with the ball construction, intended use (e.g., for ladies, beginners, amateur golfers, skilled amateur golfers, professionals). The number of dimples may be set at generally from about 250 to about 500.

The golf ball of the invention, as described above, includes the above rubber composition in a molded and vulcanized form as a core or other structural ball component. To facilitate identification of the core or other structural component, this molded and vulcanized material has been subjected to coloration. However, when the vulcanized rubber powder obtained by rendering processing scrap and waste generated from cutting up or surface grinding such cores or other structural components into a powder is used in the manufacture of other golf balls, undesirable effects due to such coloration do not arise.

That is, when vulcanized rubber powder obtained from the above-described molded and vulcanized material in the inventive golf ball is used in the manufacture of other golf balls, by liquid washing the vulcanized rubber powder, the soluble pigment contained within the powder is removed, enabling the vulcanized rubber powder to be easily decolorized.

Next, the method of manufacturing golf balls using such a vulcanized rubber powder, disclosed herein as the second aspect of the invention, is described.

The manufacturing method according to the second aspect of the invention, as mentioned above, provides a method of manufacturing a golf ball having, as a structural component therein, a molded and vulcanized material obtained by molding and vulcanizing a rubber composition which includes a base rubber and an unsaturated carboxylic acid or a salt thereof and to which a vulcanized rubber powder has been added.

Here, the base rubber and the unsaturated carboxylic acid or salt thereof are exemplified by the same types of base rubbers and unsaturated carboxylic acids or salts thereof as those mentioned above for the golf ball according to the first aspect of the invention. Moreover, as in the first aspect of the invention, various additives and compounding ingredients such as inorganic fillers, organic peroxides, sulfur, sulfur compounds and antioxidants may be suitably included in this rubber composition. These additives and compounding ingredients are exemplified by the same additives and ingredients as in the first aspect of the invention. The amounts of these respective ingredients are also the same as mentioned above for the first aspect of the invention.

The vulcanized rubber powder compounded in this rubber composition includes a soluble pigment. This soluble pigment is not subject to any particular limitation. However, the use of water-soluble pigments is especially preferred because washing with water is possible and the toxicity is very low. Such water-soluble pigments are exemplified by the same water-soluble pigments as mentioned above for the golf ball according to the first aspect of the invention.

The vulcanized rubber powder may be, for example, processing scrap such as abraded powder generated by surface-grinding molded and vulcanized materials such as the cores of golf balls according to the first aspect of the invention, i.e., molded and vulcanized materials obtained from rubber compositions containing the soluble pigment, and ground waste from such molded and vulcanized materials, which processing scrap and waste has been rendered into a powder.

In the inventive method of manufacturing, the vulcanized rubber powder is included in the rubber composition after being decolorized by liquid washing to remove the soluble pigment from the powder. The liquid used for such washing is exemplified by water and by surfactant solutions which use an alcohol as the solvent. Because residual ingredients such as surfactants may have an effect on the core performance, and in order to keep costs down, the use of water is preferred.

The method used for such liquid washing may involve, for example, spraying the starting vulcanized rubber powder with a liquid, although immersing the vulcanized rubber powder in a liquid, and especially water, is preferred. In this case, the amount of liquid used may be suitably selected, but is preferably at least 5 L of liquid, more preferably from 5 to 50 L of liquid, and most preferably from 5 to 30 L of liquid, per 1,000 g of the powder.

When the amount of liquid is smaller than the amount specified here, it may not be possible to fully extract the soluble pigment present within or at the surface of the rubber in the vulcanized rubber powder. On the other hand, when the amount of liquid is larger than the amount specified here, the time required for filtration when recovering the vulcanized rubber powder increases, which may lower the production efficiency.

The temperature for extracting the soluble pigment during liquid washing is preferably from 10 to 40° C., more preferably from 15 to 35° C., and most preferably from 20 to 30° C. At temperatures lower than the above range, suitable extraction does not take place, as a result of which a large amount of soluble pigment may remain within or at the surface of the rubber. On the other hand, at temperatures higher than the above range, the increase in heating operations results in higher costs, which is economically disadvantageous.

The extraction time is preferably from 10 minutes to 24 hours, more preferably from 1 to 12 hours, and most preferably from 1 to 2 hours. Extraction may be optionally carried out under stirring, which may help to shorten the extraction time.

After the vulcanized rubber powder has been liquid-washed, the resulting vulcanized rubber powder is preferably dried. Any suitable method may be used as the drying method, although drying the filtration-separated rubber in a dryer equipped with an agitator is preferred for (i) preventing agglomeration of the rubber, (ii) uniformly drying the rubber powder, and (iii) keeping scorching and dust explosions from arising.

The temperature when carrying out drying treatment, although not subject to any particular limitation, is preferably from 105 to 160° C., more preferably from 110 to 140° C., and even more preferably from 120 to 125° C. The time required for drying is preferably at least 20 minutes, more preferably from 30 minutes to 3 hours, and even more preferably from 1 to 2 hours. If the temperature and time in drying treatment fall outside of the above ranges, it may not be possible to fully dry the vulcanized rubber powder or the powder material may be deteriorate.

The vulcanized rubber powder obtained after drying in the above drying step, i.e., the vulcanized rubber powder at the time of addition to the rubber composition, has a moisture content of preferably not more than 600 ppm, and more preferably not more than 400 ppm. By adjusting the moisture of the vulcanized rubber powder to not more than 600 ppm, it is possible to maintain the resilience of the core or other structural component being fabricated and to enhance the durability of the golf ball to changes over time.

No particular limitation is imposed on the particle size of the vulcanized rubber powder. In terms of the size of the screen openings, the particle size is preferably not more than 1,000 μm, and more preferably between 800 and 25 μm. If the particle size of the vulcanized rubber powder exceeds 1,000 μm, dispersion of the rubber powder during kneading may worsen, or the durability of the finished golf ball may worsen. On the other hand, if the particle size of the rubber powder is too small, achieving the desired hardness, which is one of the purposes for adding vulcanized rubber powder, may not be possible. Moreover, the cost reductions and environmental benefits associated with the addition of vulcanized rubber powder may diminish.

The method of adjusting the particle size is exemplified by a method in which rubber powder within a predetermined particle size range is obtained by applying the dried vulcanized rubber powder to a sieve. In such a case, the size of the screen openings may be suitably selected according to the particle size of the rubber powder being collected, although it is desirable to use rubber powder having a particle size in a range of preferably from 75 to 1,000 μm, and more preferably from 250 to 425 μm.

Sieves have the ability, when arranged in a vertical stack with the coarsest mesh at top and progressively finer meshes below, to collect at one time discrete powders of the respective particle sizes. Those powders which are too large for use as the material of the invention are further reduced to a smaller size or, as the case may be, discarded.

In the practice of the invention, the vulcanized rubber powder is added to the rubber composition used to form the ball component, and especially the core, of the golf ball, in which case this vulcanized rubber powder may be advantageously used as a hardness modifying agent. Also, the durability of the ball may be enhanced by the addition of vulcanized rubber powder. Moreover, the material costs of golf balls can be reduced by reusing the above-described processing scrap and waste.

The amount of vulcanized rubber powder added is suitably set, without particular limitation, according to such considerations as the makeup of the rubber composition, the intended use for the molded and vulcanized material, the performance required of the target golf ball and the design concept. In general, however, the amount may be set in a range of preferably from 0.1 to 50 parts by weight, more preferably from 0.2 to 30 parts by weight, and even more preferably from 0.5 to 10 parts by weight, per 100 parts by weight of the base rubber. If the amount of vulcanized rubber powder added is less than 0.1 part by weight, the cost-reducing effects will decrease, whereas addition in an amount of more than 50 parts by weight may result in a poor ball durability. In cases where the amount of vulcanized rubber powder added exceeds 30 parts by weight, as the amount of addition beyond this level rises, the workability in the rubber mixing operation at the time of production has a tendency to decline.

The inventive method of manufacture produces a golf ball which includes, as one structural component therein, a molded and vulcanized material obtained by molding and vulcanizing a rubber composition to which has been added the above-described vulcanized rubber powder. This manufacturing method may be used to produce one-piece solid golf balls, two-piece solid golf balls, and multi-piece solid golf balls having three or more pieces. In this case, the molded and vulcanized material making up the ball in one-piece solid golf balls, the molded and vulcanized material making up the solid core in two-piece solid golf balls, and the molded and vulcanized material making up the solid core and/or the intermediate layer in multi-piece solid golf balls is formed of a rubber composition to which a vulcanized rubber powder has been added. It is especially preferable to manufacture two-piece solid golf balls or multi-piece solid golf balls by using, as the molded and vulcanized material making up the solid cores, a molded and vulcanized material obtained from a rubber composition to which the above-described vulcanized rubber powder has been added.

The method of molding and vulcanizing the molded and vulcanized material for the solid core or other structural component using a rubber composition to which the above vulcanized rubber powder has been added may be carried out in accordance with conventional practice. Molding and vulcanization may be carried out at typically from 150 to 170° C. for a period of from 10 to 20 minutes.

In the manufacturing method of the invention, aside from liquid washing the above-described vulcanized rubber powder and adding the washed rubber powder to the rubber composition, then molding and vulcanizing this rubber composition to form a core or other structural component, golf balls can be manufactured by a known method using known materials. For example, the intermediate layer in the manufacture of multi-piece solid golf balls may be formed of a resin material or may be formed of a rubber-based material. The resin material used to form the intermediate layer, as in the case of the golf ball according to the first aspect of the invention, is exemplified by ionomer resins, polyester-type elastomers, polyamide-type elastomers, styrene-type elastomers, polyurethane-type elastomers, olefin-type elastomers, and mixtures thereof. In cases where the intermediate layer is formed of a rubber-based material, a rubber composition to which the above-described vulcanized rubber powder has been added may be molded and vulcanized to form this intermediate layer.

A known material may be used as the golf ball cover material in cases where a two-piece solid golf ball or a multi-piece solid golf ball is to be obtained. As in the golf ball according to the first aspect of the invention, the cover material is exemplified by ionomer resins, polyester-type elastomers, polyamide-type elastomers, styrene-type elastomers, polyurethane-type elastomers, olefin-type elastomers and mixtures thereof. If so desired, this cover material may be colored by the addition of a pigment or the like.

In the manufacturing method of the invention, a vulcanized rubber powder obtained from colored golf ball cores or other structural components is added to the core or intermediate layer. However, because this vulcanized rubber powder is used after being decolorized by liquid washing to remove the soluble pigment, it has no effect on the color tone of the resulting golf ball. This makes it possible to use vulcanized rubber powder obtained from processing scrap and waste without giving rise to any disadvantages.

The molds employed when molding the various ball components in the manufacturing method of the invention are preferably molds of the same type as are customarily used when forming cores. The intermediate layer, cover and the like may also be fabricated in the customary manner. Dimples are formed on the golf ball in accordance with conventional practice, although the dimples may be suitably selected according to such considerations as the ball construction and intended use. The number of dimples, although not subject to any particular limitation, is preferably from about 250 to about 500. Dimples may be formed by providing raised and recessed features on the inner surface of the mold.

EXAMPLES

The invention is illustrated more fully below by way of the following Examples of the invention and Comparative Examples, although these Examples are not intended to limit the invention.

Examples 1 to 4, Comparative Example 1

A rubber composition was prepared by mixing the ingredients shown in Table 1, following which molding and vulcanization were carried out at 155° C. for 13 minutes, thereby producing spherical molded and vulcanized bodies of light red, red, light blue, blue, and pink color. In the table, the amounts of the respective ingredients included in the compositions are indicated in parts by weight.

The resulting molded and vulcanized bodies were centerless ground using a #500 grindstone, giving cores having a diameter of 39.0 mm and a weight of 40 g. The powder formed by such grinding was collected, yielding vulcanized rubber powders having particle sizes of 800 μm or less from the respective cores. The resulting cores were easily distinguished by their respective colors and suitable covers were formed over each of the cores, enabling golf balls to be manufactured without difficulty.

Aqueous dispersions of about 3 kg of each of the vulcanized rubber powders collected above in 30 L of water were left to stand at room temperature for 1 hour, thereby liquid washing the vulcanized rubber powders. In the case of the powders in Examples 1 to 4, extraction in this way of unsaturated carboxylic acids resulted in dispersions having a pH of 6.5 or below. Rubber powder was separated and recovered from each solution with a filtration unit, then dried at 120° C. for 2 hours using a dryer equipped with an agitating mechanism, thereby drying the rubber powder to a moisture content of 200 ppm from an original level of 25 wt % per 3 kg of the initial vulcanized rubber. This vulcanized rubber powder included flash and the like generated during molding and vulcanization; the particle size of such flash was large. Because unsaturated carboxylic acids cannot always be fully extracted from vulcanized rubbers having a larger particle size such as this, the powder was classified on a sieve having a mesh size of 0.4 mm.

Each of the vulcanized rubber powders thus obtained were examined, whereupon the vulcanized rubber powders in Examples 1 to 4 were found to have been successfully decolorized and were all white. The color in each case was substantially the same. By contrast, the vulcanized rubber powder obtained in Comparative Example 1 remained the same pink color as the core.

Details on the ingredients in Table 1 above are given below.

Cis-1,4-Polybutadiene: Available under the trade name "BR01" from JSR Corporation Zinc oxide: Available under the trade name "NANOFINE-50" from Sakai Chemical Industry Co., Ltd.

Zinc acrylate: Available from Sakai Chemical Industry Co., Ltd.

Antioxidant: Available under the trade name "Nocrac NS-6" from Ouchi Shinko Chemical Industry Co., Ltd.

Calcium carbonate: Available from Shiraishi Calcium Kaisha, Ltd.

Dicumyl peroxide: Available under the trade name "Percumyl D" from NOF Corporation Resino Red: Available under the trade name "Resino Red 72-A (LB)" from Resino Color Industry Co., Ltd.

Rubiruka SP: An anthocyanin-type red cabbage pigment available from Mitsubishi Kagaku Foods Corporation Technocolor Blue P: A gardenia blue pigment available from Mitsubishi Kagaku Foods Corporation Examples 5 and 6, Comparative Examples 2 to 4

Using the vulcanized rubber powders obtained above in Example 4 and Comparative Example 1, the rubber compositions of the formulations shown in Table 2 below were prepared, then molded and vulcanized at 155° C. for 13 minutes. The molded and vulcanized bodies were then surface ground, giving solid cores having a diameter of 39.0 mm and a weight of 40 g. The colors of the respective solid cores obtained are shown in Table 2.

A yellow cover of the composition shown in Table 3 was injection-molded to a thickness of 1.9 mm over each of these solid cores, thereby giving golf balls having 432 dimples on the surface. The hues of the golf balls thus obtained were evaluated using as the control Comparative Example 2, in which vulcanized rubber powder was not added to the core. The results are shown in Table 2. Cases in which the hue was the same as that of the control were rated as "Good." Cases where there was a difference in hue were rated as "NG."

TABLE 1

| | | Example | | | | Comparative |
|---|---|---|---|---|---|---|
| | | 1 | 2 | 3 | 4 | Example 1 |
| Base rubber | cis-1,4 Polybutadiene | 100 | 100 | 100 | 100 | 100 |
| Compounding ingredients | Zinc oxide | 30 | 30 | 30 | 30 | 30 |
| | Zinc acrylate | 20 | 20 | 20 | 20 | 20 |
| | Antioxidant | 0.1 | 0.1 | 0.1 | 0.1 | 0.1 |
| | Calcium carbonate | 0.1 | 0.1 | 0.1 | 0.1 | 0.1 |
| | Dicumyl peroxide | 0.6 | 0.6 | 0.6 | 0.6 | 0.6 |
| Colorants | Resino Red | | | | | 0.01 |
| | Rubiruka SP | 0.01 | 0.1 | | | |
| | Technocolor Blue P | | | 0.01 | 0.1 | |
| Core color | | light red | red | light blue | blue | pink |
| Powder color after solution washing | | white | white | white | white | pink |

*Ingredient amounts are all in parts by weight

TABLE 2

| | | | Comparative Example | | | Example | |
|---|---|---|---|---|---|---|---|
| | | | 2 | 3 | 4 | 5 | 6 |
| Core | Base rubber | cis-1,4-Polybutadiene | 100 | 100 | 100 | 100 | 100 |
| | Compounding ingredients | Zinc oxide | 30 | 30 | 30 | 30 | 30 |
| | | Zinc acrylate | 20 | 20 | 20 | 20 | 20 |
| | | Antioxidant | 0.1 | 0.1 | 0.1 | 0.1 | 0.1 |
| | | Calcium carbonate | 0.1 | 0.1 | 0.1 | 0.1 | 0.1 |
| | | Dicumyl peroxide | 0.6 | 0.6 | 0.6 | 0.6 | 0.6 |
| | Vulcanized rubber powder | Rubber powder from Comparative Example 1 | | 3 | 7 | | |
| | | Rubber powder from Example 4 | | | | 3 | 7 |
| Evaluation | Core color | | white | lighk pink | pink | white | white |
| | Evaluation of golf ball hue | | control | NG | NG | Good | Good |

*Ingredient amounts are all in parts by weight

TABLE 3

| | | |
|---|---|---|
| Outer cover layer | Pandex T8295 | 50 |
| | Pandex T8260 | 50 |
| | Polyethylene wax | 1 |
| | Yellow pigment | 5 |

*Ingredient amounts are all in parts by weight

Details on the various ingredients in Table 2 are the same as in Table 1. The ingredients in Table 3 are described below.

Pandex T8295: A thermoplastic polyurethane elastomer, available from DIC Bayer Polymer Pandex T8260: A thermoplastic polyurethane elastomer, available from DIC Bayer Polymer Polyethylene wax: Available under the trade name "Umex 2000" from Sanyo Chemical Industries, Ltd.

Yellow pigment: Available under the trade name "Resino Yellow 3GR #55" from Resino Color Industry Co., Ltd.

Examples 7 and 8, Comparative Examples 5 to 7

Using the vulcanized rubber powders obtained above in Example 4 and Comparative Example 1, the rubber compositions of the formulations shown in Table 4 below were prepared, then molded and vulcanized at 155° C. for 13 minutes. The molded and vulcanized bodies were then surface ground, giving solid cores having a diameter of 39.0 mm and a weight of 40 g. The colors of the respective solid cores obtained are shown in Table 4.

A yellow cover of the composition shown in Table 3 was injection-molded to a thickness of 1.9 mm over each of these solid cores, thereby giving golf balls having 432 dimples on the surface. The hues of the golf balls thus obtained were evaluated using as the control Comparative Example 5, in which vulcanized rubber powder was not added to the core. The results are shown in Table 4.

TABLE 4

| | | | Comparative Example | | | Example | |
|---|---|---|---|---|---|---|---|
| | | | 5 | 6 | 7 | 7 | 8 |
| Core | Base rubber | cis-1,4-Polybutadiene | 100 | 100 | 100 | 100 | 100 |
| | Compounding ingredients | Zinc oxide | 30 | 30 | 30 | 30 | 30 |
| | | Zinc acrylate | 20 | 20 | 20 | 20 | 20 |
| | | Antioxidant | 0.1 | 0.1 | 0.1 | 0.1 | 0.1 |
| | | Calcium carbonate | 0.1 | 0.1 | 0.1 | 0.1 | 0.1 |
| | | Dicumyl peroxide | 0.6 | 0.6 | 0.6 | 0.6 | 0.6 |
| | Pigment | Resino Yellow | 0.01 | 0.01 | 0.01 | 0.01 | 0.01 |
| | Vulcanized rubber powder | Rubber powder from Comparative Example 1 | | 3 | 7 | | |
| | | Rubber power from Example 4 | | | | 3 | 7 |
| Evaluation | Core color | | yellow | light orange | light orange | yellow | yellow |
| | Evaluation of golf ball hue | | control | NG | NG | Good | Good |

*Ingredient amounts are all in parts by weight

Resin Yellow in Table 4 is available under the trade name "Resino Yellow GL6 (LB)" from Resino Color Industry Co., Ltd. The other ingredients are the same as in Table 1.

As shown in Tables 2 and 4, the golf balls of Examples 5, 6, 7 and 8 reused, as a compounding ingredient, abraded powder (processing scrap) from the colored cores of Example 4 according to the present invention. However, because this was used after being washed with water, the hues of the resulting golf balls were the same as in Comparative Examples 2 and 5, which contained no vulcanized rubber powder. It was thus confirmed that, owing to the present invention, the cores can be easily identified by coloration and, moreover, abraded powder (processing scrap) obtained from those cores, when reused as a compounding ingredient in the production of cores for other golf balls, can be utilized without eliciting undesirable effects such as changes in the color tone of the resulting golf balls.

The invention claimed is:

1. A method of manufacturing a golf ball having, as a structural component therein, a molded and vulcanized material obtained by molding and vulcanizing a rubber composition comprising a base rubber and an unsaturated carboxylic acid or a salt thereof and to which a vulcanized rubber powder has been added, the method comprising the steps of: liquid washing a soluble pigment-containing vulcanized rubber powder so as to remove the soluble pigment; and compounding the liquid-washed vulcanized rubber powder in the rubber composition.

2. The golf ball manufacturing method of claim 1, wherein the vulcanized rubber powder has a particle size of not more than 1,000 μm.

3. The golf ball manufacturing method of claim 1, wherein the vulcanized rubber powder has, at the time of addition to the rubber composition, a moisture content of not more than 600 ppm.

4. The golf ball manufacturing method of claim 1, wherein the vulcanized rubber powder is processing scrap or waste from structural components of other golf balls which has been rendered into a powder.

5. The golf ball manufacturing method of claim 4, wherein the vulcanized rubber powder is a powder formed by surface grinding golf ball cores obtained by molding and vulcanizing a rubber composition containing a base rubber, an unsaturated carboxylic acid or a salt thereof, and a soluble pigment.

6. The golf ball manufacturing method of claim 1, wherein the soluble pigment is a water-soluble pigment and the vulcanized rubber powder containing the water-soluble pigment is liquid-washed using water.

7. The golf ball manufacturing method of claim 6, wherein the soluble pigment is one or more water-soluble pigment selected from among naturally occurring pigments.

8. The golf ball manufacturing method of claim 1 which produces a golf ball wherein the molded and vulcanized material obtained by molding and vulcanizing the rubber composition serves as a core.

* * * * *